US010649396B2

(12) United States Patent
Morgan

(10) Patent No.: US 10,649,396 B2
(45) Date of Patent: May 12, 2020

(54) IMAGING CARTRIDGE WITH SHIFTABLE IMAGING COMPONENTS

(71) Applicant: CLOVER IMAGING GROUP, LLC, Hoffman Estates, IL (US)

(72) Inventor: John Morgan, Newbury Park, CA (US)

(73) Assignee: CLOVER IMAGING GROUP, LLC, Hoffman Estates, IL (US)

( * ) Notice: Subject to any disclaimer, the term of this patent is extended or adjusted under 35 U.S.C. 154(b) by 0 days.

(21) Appl. No.: 16/412,000

(22) Filed: May 14, 2019

(65) Prior Publication Data

US 2019/0346807 A1 Nov. 14, 2019

Related U.S. Application Data

(60) Provisional application No. 62/671,163, filed on May 14, 2018.

(51) Int. Cl.
*G03G 21/16* (2006.01)
*G03G 15/08* (2006.01)

(52) U.S. Cl.
CPC ..... *G03G 21/1647* (2013.01); *G03G 15/0865* (2013.01); *G03G 21/1676* (2013.01)

(58) Field of Classification Search
CPC ..... G03G 21/1647; G03G 21/1676; G03G 15/0865
See application file for complete search history.

(56) References Cited

U.S. PATENT DOCUMENTS 7,773,911 B2 8/2010 Kawamura
2013/0251402 A1* 9/2013 Yamashita ..... G03G 21/18 399/111
2016/0091815 A1 3/2016 Morgan
2018/0321637 A1* 11/2018 Sato ..... G03G 21/1842

FOREIGN PATENT DOCUMENTS

WO 2007003005 A2 1/2007
WO 2015083842 A1 6/2015

OTHER PUBLICATIONS

International Search Report and Written Opinion for Application No. PCT/US2019/032221, dated Aug. 19, 2019, 13 pages.

* cited by examiner

*Primary Examiner* — David M. Gray
*Assistant Examiner* — Michael A Harrison
(74) *Attorney, Agent, or Firm* — Michael Best & Friedrich LLP

(57) ABSTRACT

An imaging cartridge installable in an image forming device. The image forming device includes a rotational driving member and at least one cartridge guide defining a guide path. The cartridge includes a first cartridge portion engageable with the at least one cartridge guide for movement along the guide path and a second cartridge portion coupled to the first cartridge portion. The second cartridge portion includes a drive receiving member configured for engagement with the rotational driving member and at least one of a drum unit assembly, a hopper, a developer roller, and a regulating blade. The second cartridge portion is moveable with respect to the first cartridge portion between a first position, in which the drive receiving member is not engageable with the rotational driving member, and a second position, in which the drive receiving member is engageable with the rotational driving member.

16 Claims, 8 Drawing Sheets

IMAGING CARTRIDGE WITH SHIFTABLE IMAGING COMPONENTS

CROSS-REFERENCE TO RELATED APPLICATIONS

This application claims priority to U.S. Provisional Patent Application No. 62/671,163, filed May 14, 2018, the entire contents of which are incorporated herein by reference.

FIELD OF THE INVENTION

The application generally relates to imaging, or printer, cartridges.

BACKGROUND OF THE INVENTION

Printers and copiers often use imaging cartridges which store and transmit toner, developer, or another imaging material, to an intended medium, such as paper. Imaging cartridges come in a variety of configurations. Although specific constructions vary among manufacturers and printers, many imaging cartridges include components such as a toner hopper, a toner-regulating blade, a developer roller, a variety of seals, and in the case of so-called "all-in-one" cartridges, the imaging cartridge may also include a primary charge roller, an organic photo-conductor drum, and a toner waste section.

One challenge faced by printer and toner cartridge manufacturers is how to engage the printer drive system with the imaging cartridge. In most cases, rotational driving force from the printer must be transmitted to the imaging cartridge through a drive arrangement that also allows for the smooth insertion and removal of the imaging cartridge from the printer.

SUMMARY OF THE INVENTION

In one aspect, the invention provides an imaging cartridge installable in an image forming device. The image forming device includes a rotational driving member and at least one cartridge guide defining a guide path. The cartridge includes a first cartridge portion engageable with the at least one cartridge guide for movement along the guide path and a second cartridge portion coupled to the first cartridge portion. The second cartridge portion includes a drive receiving member configured for engagement with the rotational driving member and at least one of a drum unit assembly, a hopper, a developer roller, and a regulating blade. The second cartridge portion is moveable with respect to the first cartridge portion between a first position, in which the drive receiving member is not engageable with the rotational driving member, and a second position, in which the drive receiving member is engageable with the rotational driving member.

In one construction, the drive receiving member is translationally fixed and rotationally fixed to the drum unit assembly, wherein the drum unit assembly defines a longitudinal axis, and where the second cartridge portion moves relative to the first cartridge portion in a direction parallel to the longitudinal axis. In one construction, a cartridge engaging mechanism moves the second cartridge portion relative to the first cartridge portion, wherein the cartridge engaging mechanism includes at least one guided body and at least one guiding member that guides movement of the at least one guided body. In such a construction, the cartridge engaging mechanism includes a force transfer surface for transferring and exerting a force from at least one of the first cartridge portion and the second cartridge portion to move the first cartridge portion. In such a construction, the force transfer surface is a cam body moveably disposed on the first cartridge portion, wherein the cam body is engageable with the second cartridge portion to permit movement of the second cartridge portion between the first position and the second position. In such a construction, the cam body is a rotatable cam body having a first lobed portion and a second lobed portion, wherein the second lobed portion is larger than the first lobed portion. In such a construction, the second cartridge portion moves to the first position in response to abutment between the first lobed portion and the second cartridge portion, and wherein the second cartridge portion moves to the second position in response to abutment between the second lobed portion and the second cartridge portion. In another construction, the force transfer surface is a ramped rail moveably disposed on the first cartridge portion, wherein the ramped rail is engageable with the second cartridge portion to permit movement of the second cartridge portion between the first position and the second position. In one construction, a biasing member urges the second cartridge portion towards the first position. In one construction, the drive receiving member and the rotational driving member are decoupled when the second cartridge portion, and more specifically, the drum unit assembly is in the first position.

In another aspect, the invention provides an imaging cartridge including a first frame and a second frame at least partially supported by the first frame. The second frame includes a rotatable imaging component selected from the group consisting of a developer roller, a photoconductive drum, and a charging roller. The rotatable imaging component is rotatable about an axis. The second frame is moveable relative to the first frame in a direction having at least a component that is parallel to the axis.

In one construction, a drive receiving member is translationally fixed and rotationally fixed to the rotatable imaging component, and the drive receiving member is configured to transmit rotational motion to the rotatable imaging component. In one construction, a cartridge engaging mechanism moves the second cartridge portion relative to the first cartridge portion. In one construction, the cartridge engaging mechanism includes at least one guided body and at least one guiding member that guides movement of the at least one guided body. In one construction, the cartridge engaging mechanism includes a cam body moveably disposed on the first cartridge portion, wherein the cam body defines a force transfer surface that is engageable with the second cartridge portion to move the second cartridge portion between the first position and the second position. In such a construction, the cam body is a rotatable cam body having a first lobed portion and a second lobed portion, wherein the second lobed portion is larger than the first lobed portion. In such a construction, the second cartridge portion moves to the first position in response to abutment between the first lobed portion and the second cartridge portion, and wherein the second cartridge portion moves to the second position in response to abutment between the second lobed portion and the second cartridge portion. In one construction, a biasing member urges the second cartridge portion towards the first position.

Other aspects of the invention will become apparent by consideration of the detailed description and accompanying drawings.

DETAILED DESCRIPTION

Before any embodiments of the application are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
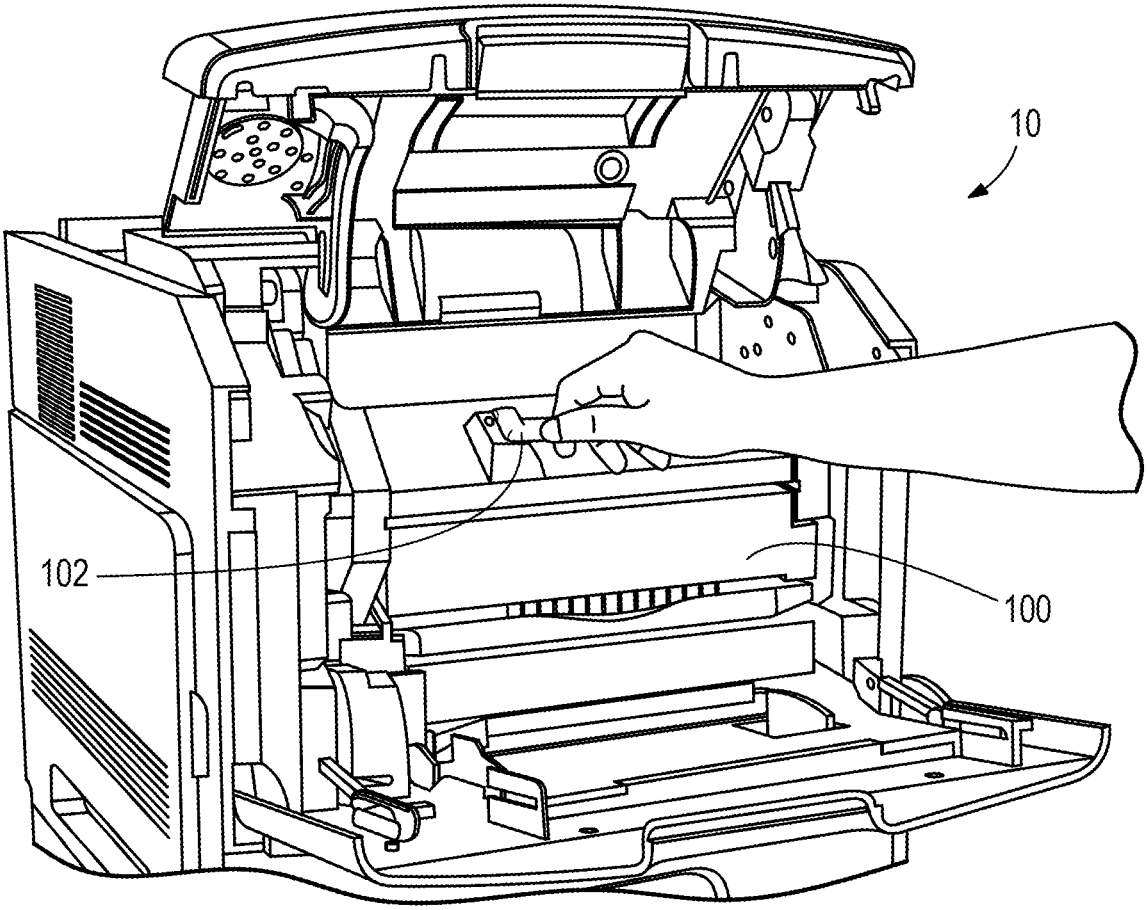
FIG. 1 is a perspective view of a printer and a toner cartridge in accordance with an embodiment of the invention, illustrating the toner cartridge received within the printer.

FIG. 1 illustrates an image forming device embodied as a printer 10 including an imaging cartridge 100 (e.g., a toner cartridge) that stores and, in cooperation with components of the printer 10, transfers toner to an intended medium, such as paper. The toner cartridge 100 includes a handle 102 that a user may grasp to facilitate the insertion or removal process of the toner cartridge 100 relative to the printer 10. The printer 10 supports movement of the toner cartridge 100 along a guide path via a cartridge guide during the insertion or removal process. The toner cartridge 100 is a consumable component used in a printing system (e.g., network printers, laser printers, photocopiers, etc.). In other embodiments, the image forming device may alternatively be a copy machine, a facsimile machine, a scanning machine, or other similar device.

Figure 2:
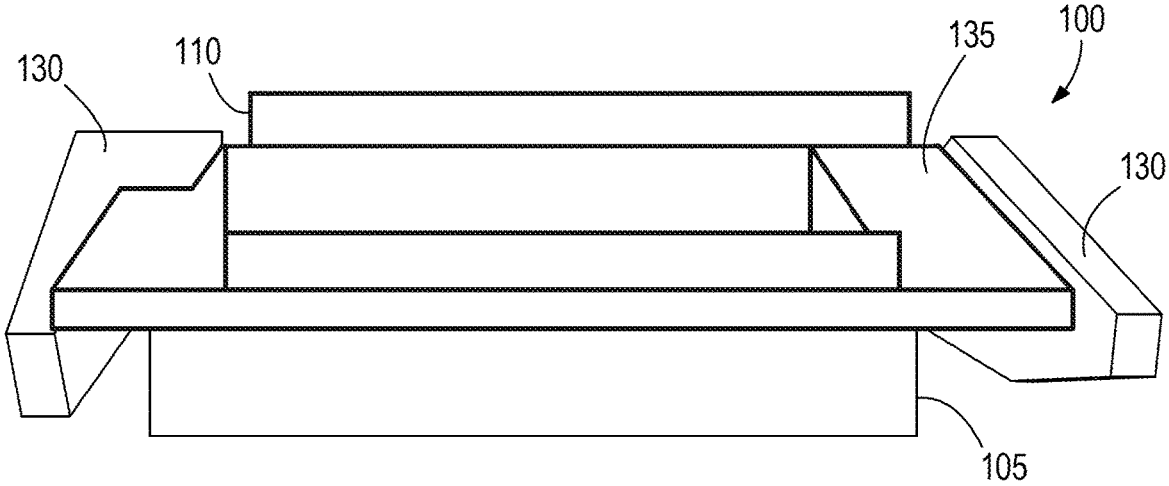
FIG. 2 is a schematic view of a toner cartridge in accordance with an embodiment of the invention, illustrating the toner cartridge in a first position.
Figure 3:
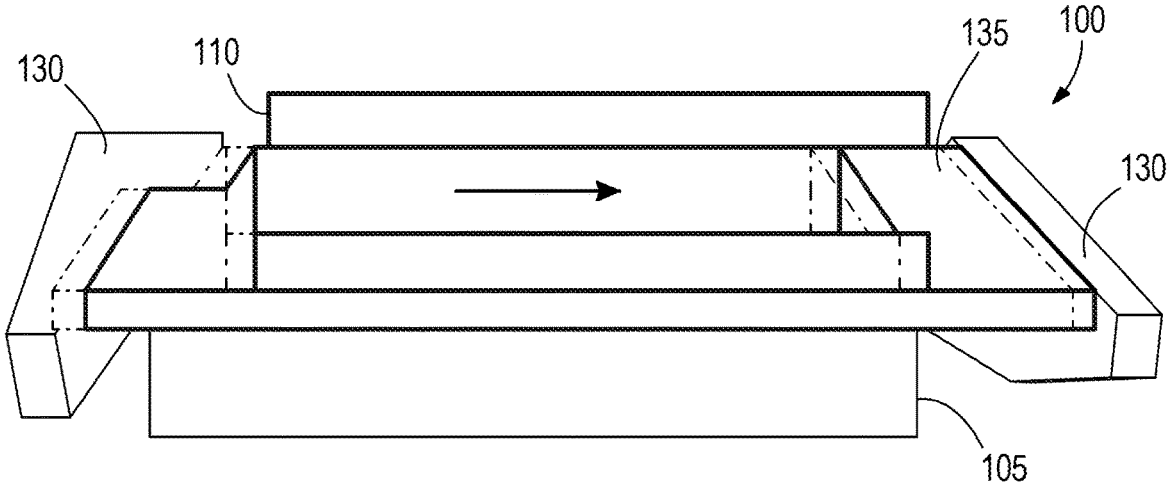
FIG. 3 is a schematic view of the toner cartridge of FIG. 1, illustrating the toner cartridge in a second position.
Figure 4:
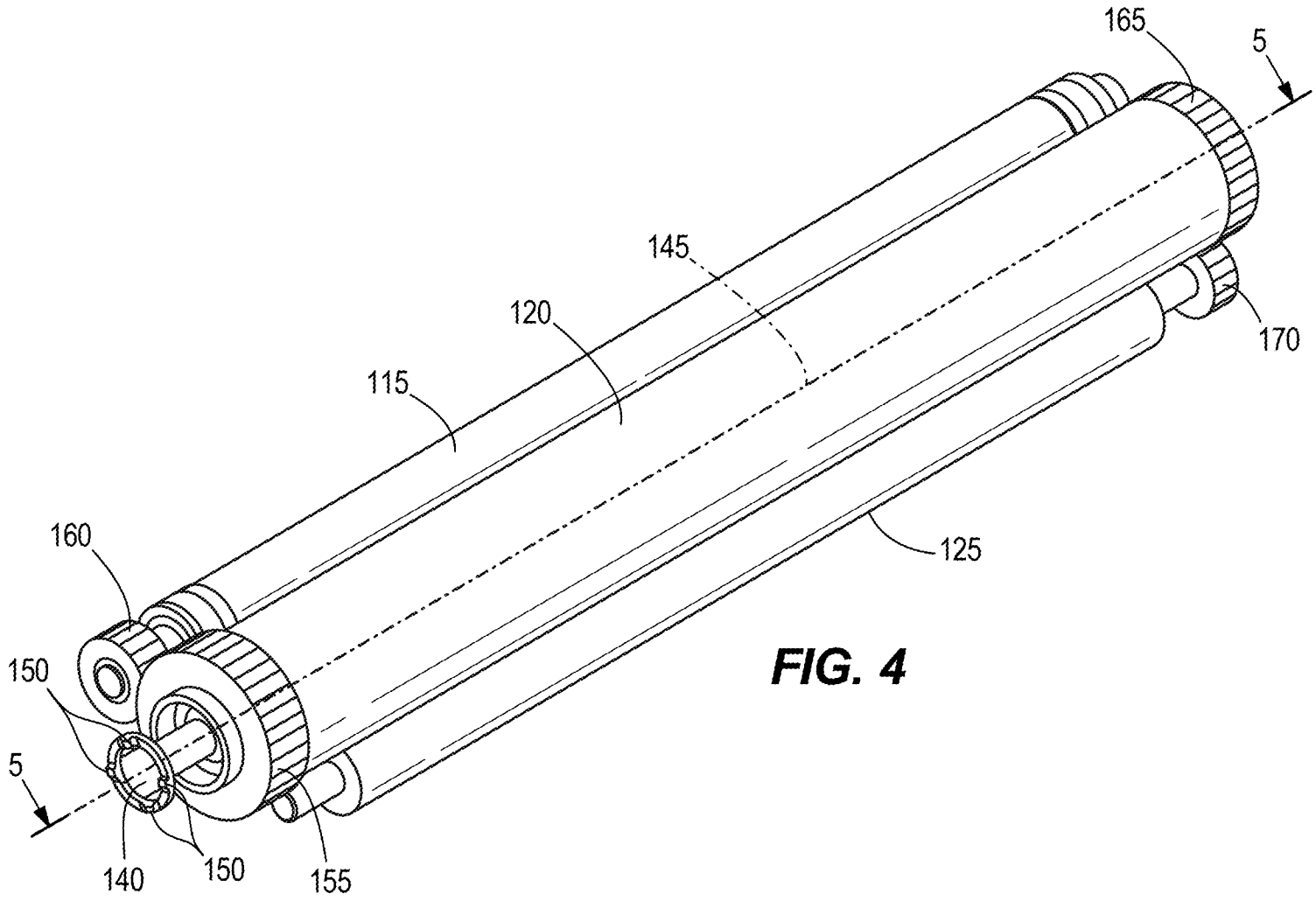
FIG. 4 is a perspective view of a portion of the toner cartridge, illustrating a developer roller, an organic-photo conductor roller, and a primary charge roller.

With reference to FIGS. 2-4, the toner cartridge 100 of the illustrated embodiment is an "all-in-one" cartridge and further includes the following components or elements: a toner hopper 105 for storing a mass of toner, a waste bin 110 for collecting residual toner, a developer roller (i.e., a magnetic roller or a developer unit) 115; an organic photo-conductor (OPC) drum 120; and a primary charge roller (PCR) 125. The illustrated toner cartridge 100 further includes a wiper blade embedded within the waste bin 110 and disposed adjacent the OPC drum 120. The wiper blade contacts the OPC drum 120 and wipes residual toner (i.e., toner remaining on the OPC drum 120 after transfer to the intended medium) from the OPC drum 120. The wiped residual toner is collected by the waste bin 110. In other embodiments, the toner cartridge 100 may include more or fewer components. For example, alternative embodiments of the cartridge 100 may be developer cartridges that do not include an OPC drum or a PCR. In such embodiments, the OPC drum and PCR may be part of the printer or may be provided as a separately removable drum unit.

During a printing sequence, toner is collected from the toner hopper 105 by the rotating developer roller 115 and electrostatically transferred from the developer roller 115 to the OPC drum 120. A laser system having a laser beam, located within the printing system, scans an electrostatic image onto the OPC drum 120 with the laser beam. In some printers, the electrostatic image produced by the laser corresponds to the image to be printed. In other printers, the laser forms an electrostatic image that is a negative of the image that is to be printed. Regardless of the specific configuration, toner carried by the developer roller 115 is electrostatically attracted to the electrostatic image produced on the OPC drum 120 by the laser beam. The OPC drum 120 then applies the toner, which is in a pattern corresponding to the desired image, onto the intended medium by direct contact or by further electrostatic transfer. The toner is then fused to the intended medium, typically by way of a heating element (e.g., a fuser).

With continued reference to FIGS. 2-4, the toner cartridge 100 further includes a first frame or cartridge portion 130 and a second frame or cartridge portion 135 that is coupled to and moveable relative to the first cartridge portion 130. In the illustrated embodiment, the second cartridge portion 135 supports for movement therewith at least the developer roller 115, the OPC drum 120, the primary charge roller 125, and the wiper blade. Moreover, the first cartridge portion 130 supports the toner hopper 105 and the waste bin 110. In alternative embodiments, the second cartridge portion 135 may also support and carry the toner hopper 105 and the waste bin 110.

Figure 5:
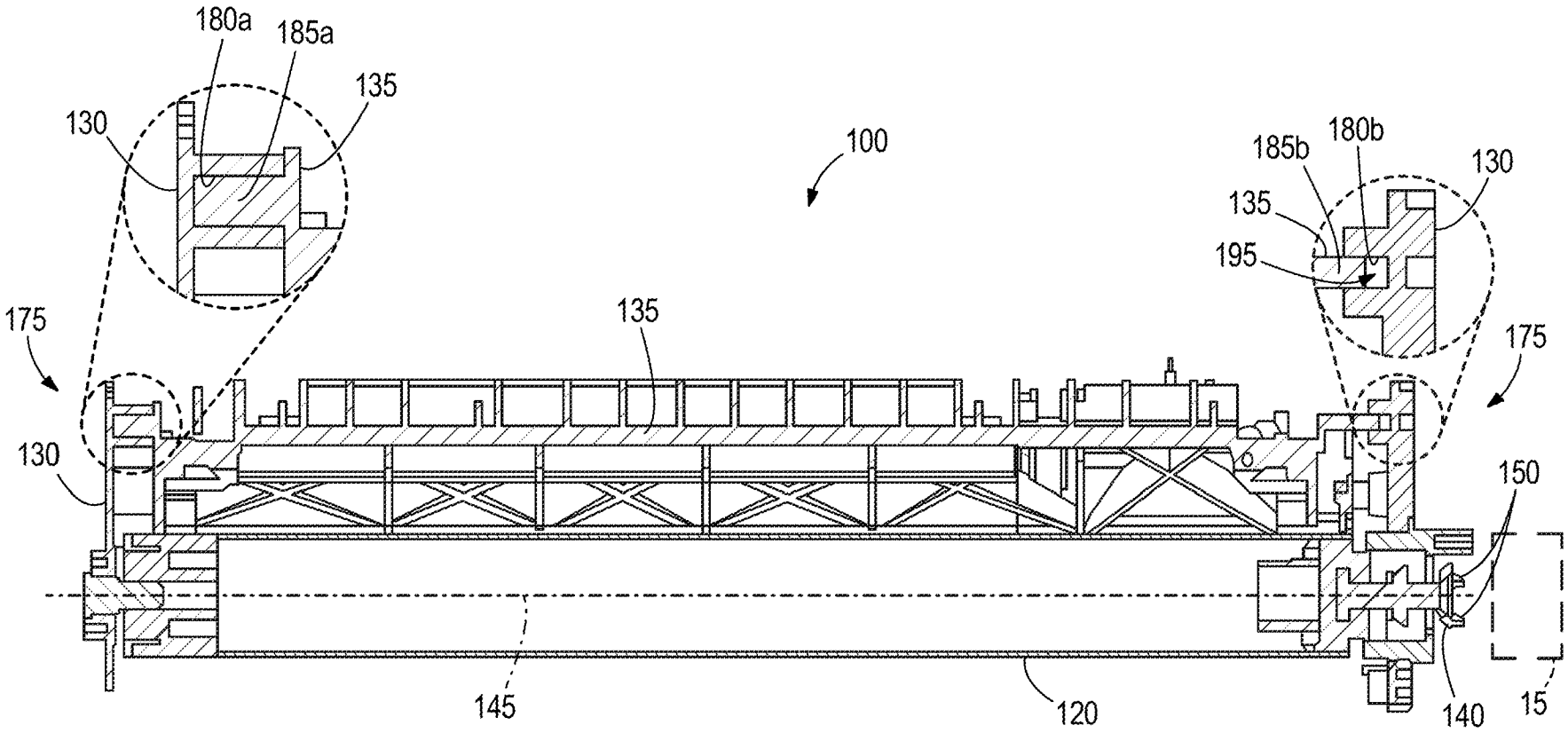
FIG. 5 is a cross-sectional view of the toner cartridge along line 5-5 of FIG. 4, illustrating the toner cartridge in the first position.

With reference to FIGS. 4 and 5, the OPC drum 120 of the toner cartridge 100 includes a drive receiving member 140 that is configured to be selectively coupled to and driven by a rotational driving member 15 of the printer 10. The driving member 15 is rotationally driven according to a given printing sequence and subsequently drives the drive receiving member 140 via mesh engagement. Particularly, the drive receiving member 140 includes teeth 150 extending away from the drive receiving member 140 towards the driving member 15, in which the teeth 150 interlock with corresponding teeth of the driving member 15. Although the drive receiving member 140 of the illustrated embodiment includes four teeth 150, in other embodiments, there may be more or fewer than four teeth 150 provided on the drive receiving member 140. In the illustrated configuration, the drive receiving member 140 is rotationally fixed and translationally fixed relative to the OPC drum 120. As such, the OPC drum 120 co-rotates with the drive receiving member 140 about its longitudinal axis 145 which, in turn, subsequently rotates the developer roller 115 and the primary charge roller 125. Specifically, the OPC drum 120 includes a first geared end 155 in mesh engagement with a geared end 160 of the developer roller 115 and a second geared end 165 in mesh engagement with a geared end 170 of the primary charge roller 125. Thus, the OPC drum 120 rotates in an opposite direction from the rotational direction of the developer roller 115 and the primary charge roller 125.

Figure 6:
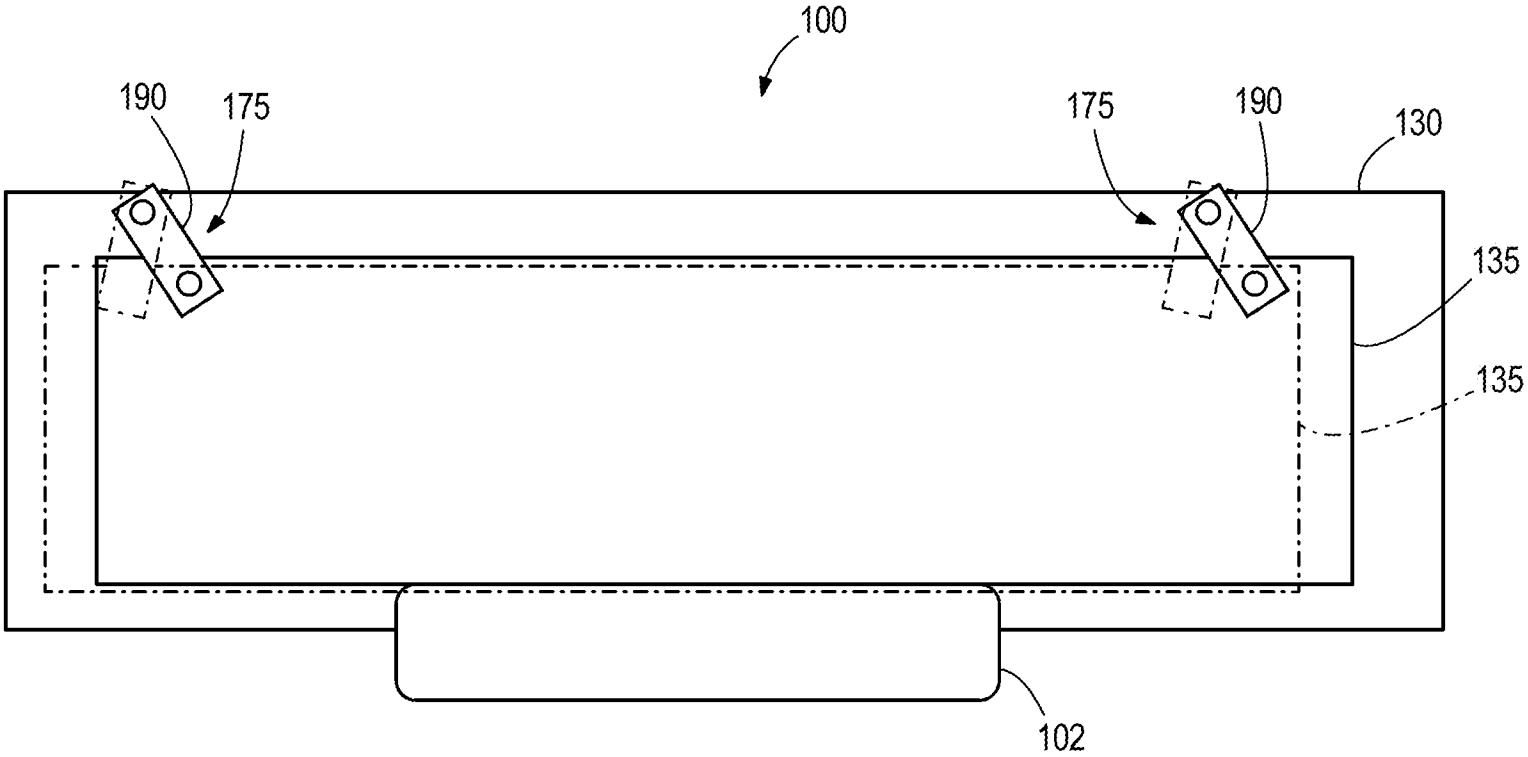
FIG. 6 is a schematic view of the toner cartridge of FIG. 1, illustrating a cartridge engaging mechanism.

With reference to FIGS. 5 and 6, the second cartridge portion 135 is moveable relative to the first cartridge portion 130 via a cartridge engaging mechanism 175. Specifically, the second cartridge portion 135 is moveable in a direction along the longitudinal axis 145 of the OPC drum 120. The cartridge engaging mechanism 175 of the illustrated embodiment includes a first plurality of guiding apertures or members 180*a* (although only one of which is shown) disposed at one end of the first cartridge frame 130 and a second plurality of guiding apertures or members 180*b* (although only one of which is shown) disposed at an opposing end of the first cartridge frame 130, both of which slideably receive corresponding guided posts or bodies 185*a*, 185*b* of the second cartridge portion 135. The cartridge engaging mechanism 175 may further include linkages 190 (FIG. 6) that facilitate guiding movement and limiting the distance traveled of the second cartridge portion 135 relative to first cartridge portion 130. As illustrated in FIG. 6, the second cartridge portion 135 is moveable between a first position (as shown in phantom lines), in which the drive receiving member 140 is not engageable with the rotational driving member 15, and a second position (as shown in solid lines) in which the drive receiving member 140 is engageable with the rotational driving member 15. Furthermore, when the second cartridge portion 135 is in the first position, the guided bodies 185*a* abut the guiding members 180*a* while, at the other end, an air gap 195 (FIG. 5) exists between the guiding members 180*b* and the guided bodies 185*b*. When the second cartridge portion 135 is in the second position, the air gap 195 exists between the guided bodies 185*a* and the guiding members 180*a* while the guided bodies 185*b* abuts the guiding members 180*b*. In the illustrated embodiment, a user may grasp the handle 102 to maneuver the movement of the second cartridge portion 135 between the first and second positions. As discussed further below, a detent mechanism, a quick-release mechanism, or other similar type of mechanism may be provided to maintain the second cartridge portion 135 in the second position.

During a printing sequence, the supply of toner within the toner hopper 105 may begin to empty, in which case the current toner cartridge 100 should be removed from the printer 10 and replaced with a new toner cartridge 100. To do so, a user grasps the handle 102 of the toner cartridge 100 and moves the second cartridge portion 135 from the second position to the first position, thereby removing the mesh engagement between the rotational driving member 15 of the printer 10 and the drive receiving member 140 of the toner cartridge 100. At this point, it is safe to remove the toner cartridge 100 from the printer 10 without the risk of inadvertent damage to either of the drive receiving member 140 or the rotational driving member 15. Next, the new toner cartridge 100 is inserted into the printer 10, where a user once again grasps the handle 102 of the toner cartridge 100 and moves the second cartridge portion 135 from the first position to the second position, thereby reinstating the mesh engagement between the rotational driving member 15 of the printer 10 and the drive receiving member 140 of the toner cartridge 100.

Figure 7:
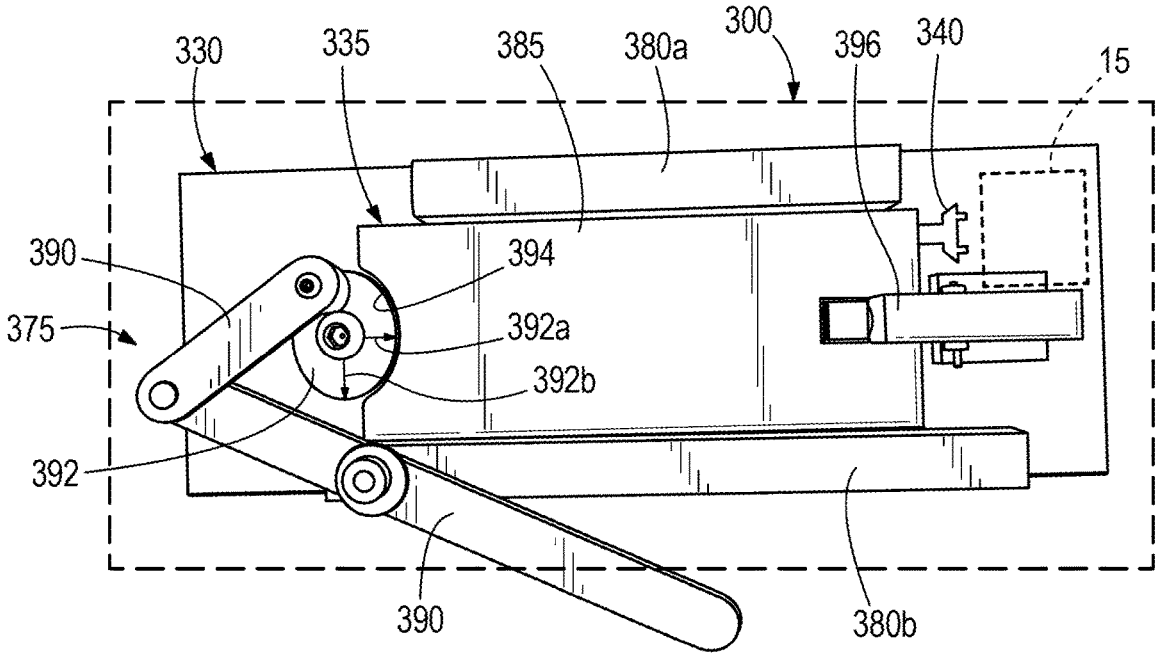
FIG. 7 is a plan view of a cartridge engaging mechanism for the toner cartridge in accordance with another embodiment of the invention, illustrating the toner cartridge in a first position.
Figure 8:
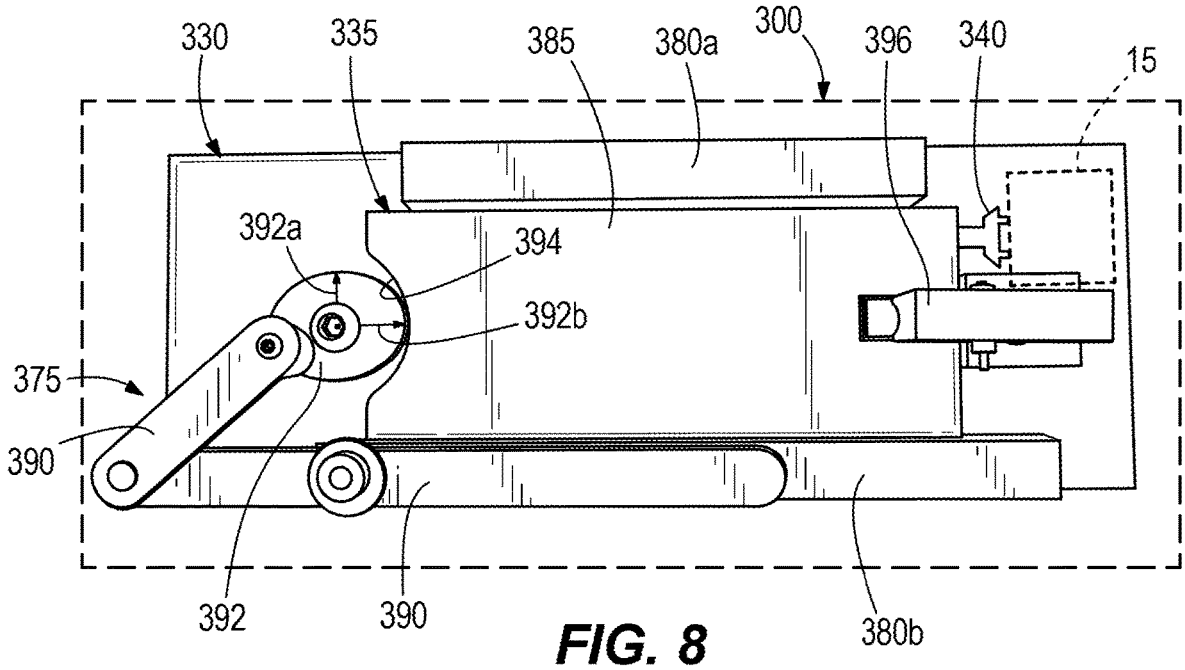
FIG. 8 is a plan view of the cartridge engaging mechanism for the toner cartridge of FIG. 7, illustrating the toner cartridge in a second position.

FIGS. 7 and 8 illustrate a toner cartridge 300 in accordance with another embodiment of the invention. The toner cartridge 300 includes a cartridge engaging mechanism 375 that is similar to the engaging mechanism 175 described above with reference to FIGS. 1-6, with like component being shown with reference numerals plus 200. Differences between the toner cartridges 100, 300 are described below.

With reference to FIGS. 7 and 8, the second cartridge portion 335 of the toner cartridge 300 is moveable relative to the first cartridge portion 330 via the cartridge engaging mechanism 375. Specifically, the second cartridge portion 335 is moveable between a first position (FIG. 7) and a second position (FIG. 8) along the longitudinal axis 145 of the OPC drum 120. In the first position, the drive receiving member 340 is not engageable with the rotational driving member 15. In the second position (FIG. 8), the drive receiving member 340 is engageable with the rotational driving member 15.

The cartridge engaging mechanism 375 of the illustrated embodiment includes a guided body 385, a first guiding rail or member 380*a* disposed along one edge of the guided member 385, and a second guiding rail or member 380*b* disposed along an opposing edge of the guided body 385. Together, the guiding members 380*a*, 380*b* capture the guided body 385 of the second cartridge portion 335 for guided sliding movement therethrough. The cartridge engaging mechanism 375 further includes linkages 390 and a cam body 392 that is rotatable in response to manipulation (e.g., actuation) of the linkages 390. The linkages 390 and the cam body 392 are supported by the first cartridge portion 330. Also, the linkages 390 and the cam body 392 facilitate guiding movement and controlling the distance traveled of the second cartridge portion 335 relative to first cartridge portion 330. The cam body 392 includes a first lobed portion 392*a* and a second lobed portion 392*b* that is larger (e.g., greater offset or apex from the rotational center of cam body 392) than the first lobed portion 392*a*. The cam body 392 is in sliding contact within a cam groove 394 of the guided body 385 to define a force transfer surface therebetween. By actuating the linkage 390, the cam body 392 rotates through approximately 90 degrees. In one orientation (FIG. 7), the first lobed portion 392*a* is received in the cam groove 394 corresponding to the second cartridge portion 335 being in the first position. In another orientation (FIG. 8), the second lobed portion 392*b* is received in the cam groove 394 corresponding to the second cartridge portion 335 being in the second position. A biasing member 396 is mounted on the first cartridge portion 330 to bias the second cartridge portion 335 toward the first position.

Although the cam body 392 of the illustrated embodiment is coupled to the first cartridge portion 330, in other embodiments, the cam body 392 may alternatively be supported on the second cartridge portion 335 where the cam body 392 interacts with a surface on the first cartridge portion 330 to move the second cartridge portion 335 between the first and second positions.

When the second cartridge portion 335 is in the first position, the drive receiving member 340 and the driving member 15 are decoupled (i.e., there is no physical coupling of the driving member 15 and the drive receiving member 340 such that the driving member 15 and drive receiving member 340 are independently rotatable). When the second cartridge portion 335 is in the second position, the drive receiving member 340 is moved into mesh engagement with the driving member 15 of the printer 10 (FIG. 8). In the illustrated embodiment, a user may grasp and manipulate the linkage 390, which may be incorporated into the cartridge handle 102, to move the second cartridge portion 335 between the first and second positions.

During a printing sequence, the supply of toner within the toner hopper 105 may begin to empty, in which case the current toner cartridge 300 should be removed from the printer 10 and replaced with a new toner cartridge 300. To do so, a user first manipulates the linkage 390 of the toner cartridge 300 in order to place the first lobed portion 392*a* in contact with the cam groove 394, permitting movement of the second cartridge portion 335 towards the first position and removing the mesh engagement between the rotational driving member 15 of the printer 10 and the drive receiving member 340 of the toner cartridge 300. At this point, it is safe to remove the toner cartridge 300 from the printer 10 without the risk of inadvertent damage to either of the drive receiving member 340 or the rotational driving member 15. Next, the new toner cartridge 300 is inserted into the printer 10, where the user subsequently manipulates the linkage 390 to place the second lobed portion 392*b* in contact with the groove 394, thereby moving the second cartridge portion 335 toward the second position. The linkage 390 of this particular embodiment may function as the handle 102, may be incorporated into the handle 102, or may exist in addition to the handle 102 to facilitate carrying and maneuvering the cartridge 300.

Figure 9:
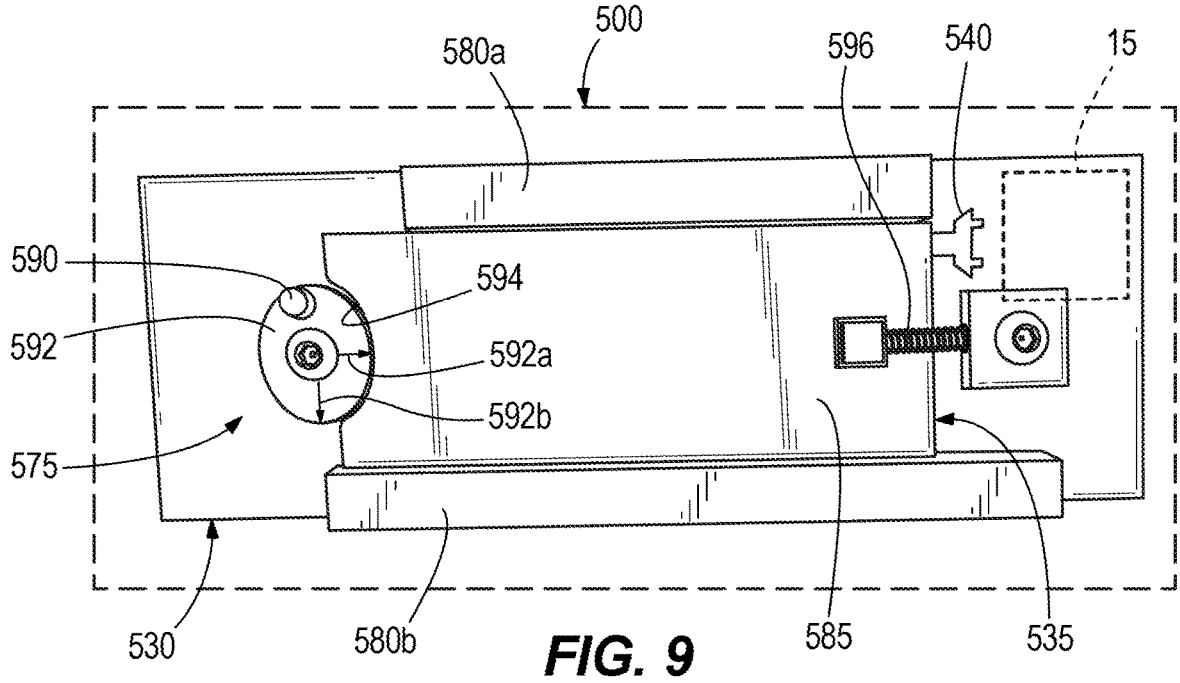
FIG. 9 is a plan view of a cartridge engaging mechanism for the toner cartridge in accordance with yet another embodiment of the invention, illustrating the toner cartridge in a first position.
Figure 10:
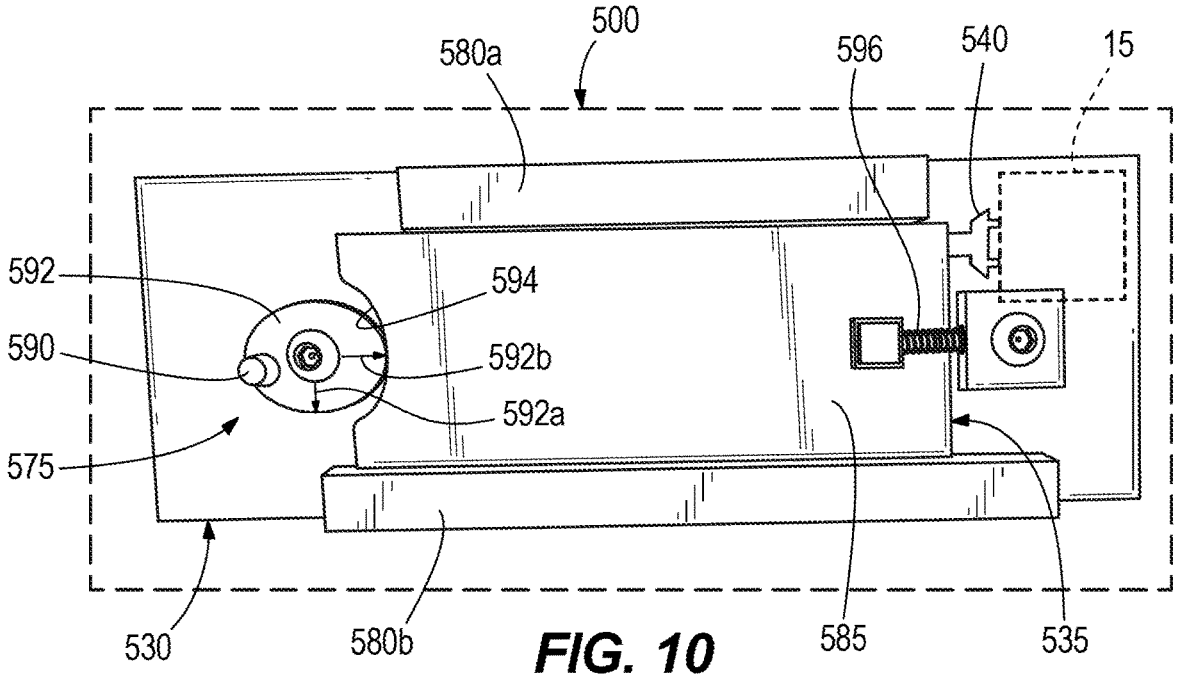
FIG. 10 is a plan view of the cartridge engaging mechanism for the toner cartridge of FIG. 9, illustrating the toner cartridge in a second position.

FIGS. 9 and 10 illustrate a toner cartridge 500 in accordance with another embodiment of the invention. The toner cartridge 500 includes a cartridge engaging mechanism 575 that is similar to the engaging mechanism 175 described above with reference to FIGS. 1-6, with like component being shown with reference numerals plus 400. Differences between the toner cartridges 100, 500 are described below.

With reference to FIGS. 9 and 10, the second cartridge portion 535 of the toner cartridge 500 is moveable relative to the first cartridge portion 530 via the cartridge engaging mechanism 575. Specifically, the second cartridge portion 535 is moveable between a first position (FIG. 9) and a second position (FIG. 10) along the longitudinal axis 145 of the OPC drum 120. In the first position, the drive receiving member 540 is not engageable with the rotational driving member 15. In the second position (FIG. 10), the drive receiving member 540 is engageable with the rotational driving member 15.

The cartridge engaging mechanism 575 of the illustrated embodiment includes a guided body 585, a first guiding rail or member 580*a* disposed along one edge of the guided body 585, and a second guiding rail or member 580*b* disposed along an opposing edge of the guided body 585. Together, the guiding members 580*a*, 580*b* capture the guided body 585 of the second cartridge portion 535 for guided sliding movement therethrough. The cartridge engaging mechanism 575 further includes a cam body 592 rotatably coupled to the first cartridge portion 530 and a post 590 disposed on the cam body 592. The cam body 592 is rotatable in response to manipulation of the post 590. The cam body 592 facilitates guiding movement and controlling the distance traveled of the second cartridge portion 535 relative to first cartridge portion 530. The cam body 592 includes a first lobed portion 592*a* and a second lobed portion 592*b* that is larger (e.g., greater offset or apex from the rotational center of cam body 592) than the first lobed portion 592*a*. The cam body 592 is in sliding contact within a cam groove 594 of the guide body 585 to define a force transfer surface therebetween. The cam body 592 is capable of rotating through approximately 90 degrees in response to manipulation of the post 590. In one orientation (FIG. 9), the first lobed portion 592*a* is received in the cam groove 594 corresponding to the first position of the second cartridge portion 535. In another orientation (FIG. 10), the second lobed portion 592*b* is received in the cam groove 594 corresponding to the second position of the second cartridge portion 535. A biasing member 596 is mounted on the first cartridge portion 530 to bias the second cartridge portion 535 toward the first position.

Although the cam body 592 of the illustrated embodiment is coupled to the first cartridge portion 530, in other embodiments, the cam body 592 may alternatively be supported on the second cartridge portion 535 where the cam body 592 interacts with a surface on the first cartridge portion 530 to move the second cartridge portion 535 between the first and second positions.

When the second cartridge portion 535 is in the first position, the drive receiving member 540 and the driving member 15 are decoupled (i.e., there is no physical coupling of the driving member 15 and the drive receiving member 340 such that the driving member 15 and drive receiving member 340 are independently rotatable). When the second cartridge portion 535 is in the second position, the drive receiving member 540 is moved into mesh engagement with the driving member 15 of the printer 10 (FIG. 8).

While the specific location and configuration of the post 590 will vary depending on the configuration of the cartridge and the printer, the post 590 preferably is positioned such that upon installation of the cartridge into the printer 10, the post 590 interacts with a rigid surface within the printer, causing the cam body 592 to rotate just as the drive receiving member 540 moves into co-axial alignment with the rotational driving member 15. In this way, the cam body 592 is rotated from the position shown in FIG. 9 in which the drive receiving member 540 is not engageable with the rotational driving member 15, to the position shown in FIG. 10 in which the drive receiving member 540 is engageable with the rotational driving member 15, just as the cartridge 500 becomes fully seating in the printer 10.

During a printing sequence, the supply of toner within the toner hopper 105 may begin to empty, in which case the current toner cartridge 500 should be removed from the printer 10 and replaced with a new toner cartridge 500. To do so, a user begins pulling the cartridge 500 out of the printer 10. By pulling the cartridge 500 out of the printer, the post 590 interacts with the rigid surface within the printer 10 which turns the cam body 592 and places the first lobed portion 592*a* in contact with the cam groove 594. This, in turn, causes movement of the second cartridge portion 535 towards the first position and removes the mesh engagement between the rotational driving member 15 of the printer 10 and the drive receiving member 540 of the toner cartridge 500. At this point, it is safe to remove the toner cartridge 500 from the printer 10 without the risk of inadvertent damage to either of the drive receiving member 540 or the rotational driving member 15. Next, the new toner cartridge 500 is inserted into the printer 10, where the post 590 engages the rigid surface within the printer 10 which turns the cam body 592 to place the second lobed portion 592*b* in contact with the groove 594. This, in turn, moves the second cartridge portion 535 toward the second position. In this particular embodiment, the toner cartridge 500 is also provided with the handle 102 to facilitate the insertion and removal process of the cartridge 300 relative to the printer 10.

FIGS. 11 and 12 illustrate a toner cartridge 700 in accordance with another embodiment of the invention. The toner cartridge 700 includes a cartridge engaging mechanism 775 that is similar to the engaging mechanism 175 described above with reference to FIGS. 1-6, with like component being shown with reference numerals plus 600. Differences between the toner cartridges 100, 700 are described below.

Figure 11A:
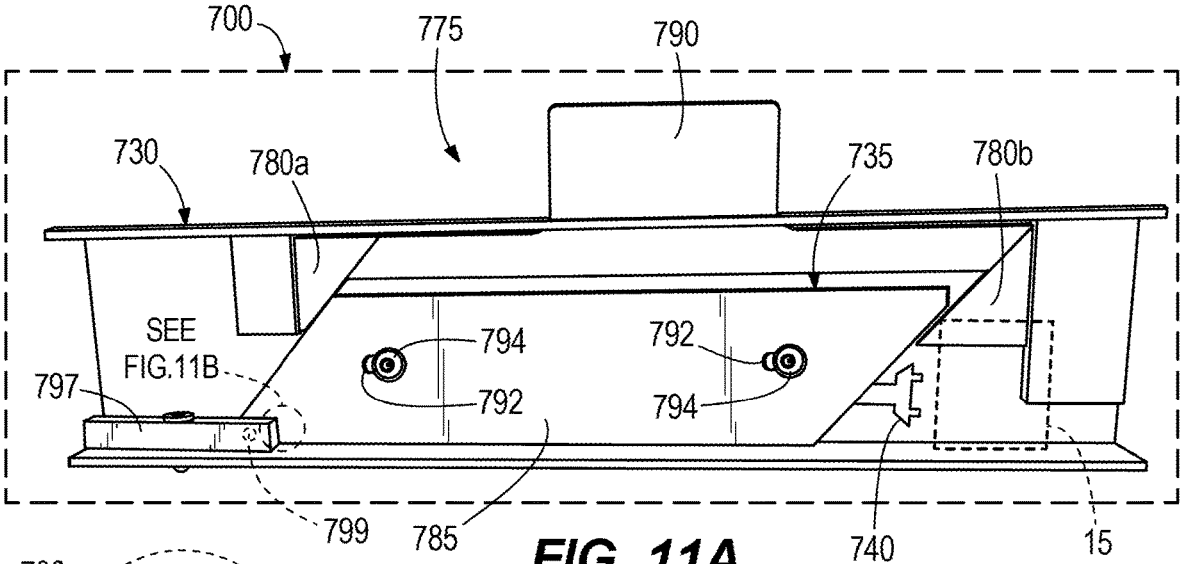
FIG. 11A is a plan view of a cartridge engaging mechanism for the toner cartridge in accordance with still yet another embodiment of the invention, illustrating the toner cartridge in a first position.
Figure 11B:
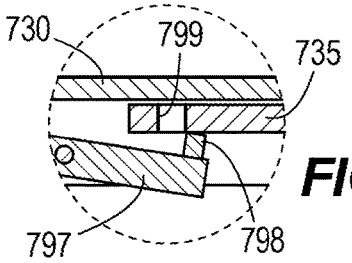
FIG. 11B is a cross-sectional view of a portion of the cartridge engaging mechanism for the toner cartridge of FIG. 11A, illustrating a quick-release latch in an unlocked state.
Figure 12A:
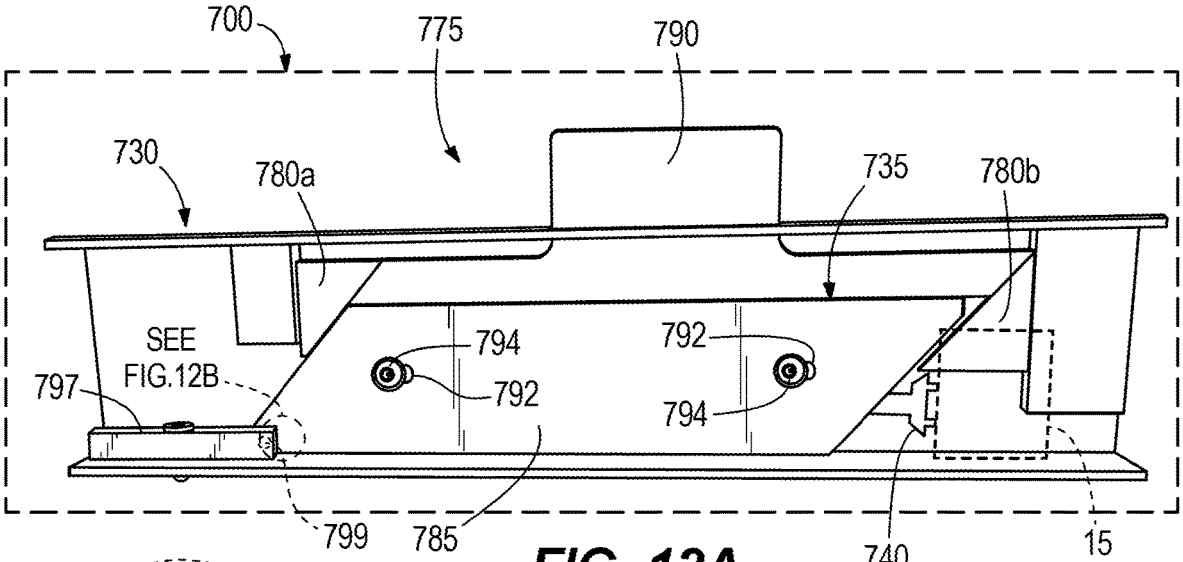
FIG. 12A is a plan view of the cartridge engaging mechanism for the toner cartridge of FIG. 11A, illustrating the toner cartridge in a second position

With reference to FIGS. 11A and 12A, the second cartridge portion 735 of the toner cartridge 700 is moveable relative to the first cartridge portion 730 via the cartridge engaging mechanism 775. Specifically, the second cartridge portion 735 is moveable between a first position (FIG. 11) and a second position (FIG. 12) along the longitudinal axis 145 of the OPC drum 120. In the first position, the drive receiving member 740 is not engageable with the rotational driving member 15. In the second position (FIG. 12), the drive receiving member 740 is engageable with the rotational driving member 15.

The cartridge engaging mechanism 775 of the illustrated embodiment includes a first ramped rail or guiding member 780*a*, a second ramped rail or guiding member 780*b*, and a guided body 785 having corresponding ramped edges that engage the first and second guiding members 780*a*, 780*b*. Together, the guiding members 780*a*, 780*b* capture the guided body 785 of the second cartridge portion 735 for guided sliding movement therethrough. The cartridge engaging mechanism 775 further includes a tab 790 connected to the first and second guiding members 780*a*, 780*b*. The tab 790 is user manipulable to cause movement of the guiding members 780*a*, 780*b* relative to the guided body 785. For example, the tab 790 is moveable from a first state (FIG. 11A) downward towards a second state (FIG. 12A), in which the first guiding member 780*a* exerts a sliding shear force on one of the ramped edges of the guided body 785 to move the second cartridge portion 735 toward the second position. In contrast, the second guiding member 780*b* exerts a sliding shear force on the other one of the ramped edges of the guided body 785 to move the second cartridge portion 735 toward the first position when the tab 790 is moveable from the second state upward towards the first state. The guided body 785 includes a pair of slots 792 that each receive a fastener 794 to limit the guided body 785 to lateral movement only. Also, the slots 792 and fasteners 794 arrangement facilitates controlling the distance traveled of the second cartridge portion 735 relative to first cartridge portion 730. In some embodiments, the tab 790 may define the cartridge handle 102 (see, e.g., FIG. 6). In other embodiments, the tab 790 may be incorporated into the handle 102 or coupled to the handle 102 via a linkage such that insertion and removal of the cartridge 700 via the handle actuates the cartridge engaging mechanism 775.

Figure 12B:
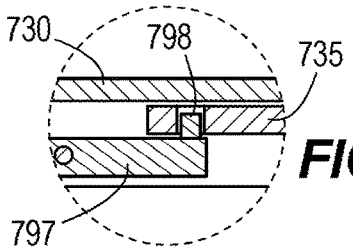
FIG. 12B is a cross-sectional view of a portion of the cartridge engaging mechanism for the toner cartridge of FIG. 12A, illustrating a quick-release latch in a locked state.

With reference to FIGS. 11B and 12B, the cartridge engaging mechanism 775 further includes a quick-release latch 797 configured to maintain the second cartridge portion 735 in the second position. Specifically, the latch 797 is pivotably coupled to the first cartridge portion 730 and includes a protrusion 798 that is selectively receivable in an aperture 799 of the second cartridge portion 735. The protrusion 798 and the aperture 799 align when the second cartridge portion 735 is moved to the second position (FIG. 12B), such that the aperture 799 receives the protrusion 798. The latch 797 is pivoted away from the second cartridge portion 735 to remove the protrusion 798 of the latch 797 from the aperture 799 (FIG. 11B), and thereby permitting the second cartridge portion 735 to move the first position. The latch 797 (and therefore the protrusion 798) is urged toward the second cartridge portion 735 via a biasing member (e.g., a torsion spring, etc.) to facilitate automatic insertion of the protrusion 735 into the aperture 799 when the second cartridge portion 735 is moved to the second position. Although not shown in FIGS. 11 and 12, a biasing member similar to the biasing member 596 illustrated in FIGS. 9 and 10 may be incorporated to work in conjunction with the latch 797. For example, upon releasing the latch 797 during cartridge removal, the biasing member may urge the second cartridge portion 735 toward the first position (FIG. 11) to disengage the drive receiving member 740 from the rotational driving member 15, thereby permitting removal of the cartridge 700.

When the second cartridge portion 735 is in the first position, the drive receiving member 740 and the driving member 15 are decoupled (i.e., there is no physical coupling of the driving member 15 and the drive receiving member 340 such that the driving member 15 and drive receiving member 340 are independently rotatable). When the second cartridge portion 735 is in the second position, the drive receiving member 740 is moved into mesh engagement with the driving member 15 of the printer 10 (FIG. 12A). In the illustrated embodiment, a user may grasp and manipulate the tab 790 to move the second cartridge portion 735 between the first and second positions.

During a printing sequence, the supply of toner within the toner hopper 105 may begin to empty, in which case the current toner cartridge 700 should be removed from the printer 10 and replaced with a new toner cartridge 700. To do so, a user first manipulates the tab 790 of the toner cartridge 700 towards the first state, causing movement of the second cartridge portion 735 towards the first position and removing the mesh engagement between the rotational driving member 15 of the printer 10 and the drive receiving member 740 of the toner cartridge 700. At this point, it is safe to remove the toner cartridge 700 from the printer 10 without the risk of inadvertent damage to either of the drive receiving member 740 or the rotational driving member 15. Next, the new toner cartridge 700 is inserted into the printer 10, where the user subsequently manipulates the tab 790 towards the second state, thereby moving the second cartridge portion 735 toward the second position. The tab 790 of this particular embodiment may serve to carry and maneuver the toner cartridge 700, whereas in other embodiments, the toner cartridge 700 is also provided with the handle 102 to facilitate carrying and maneuvering the cartridge 700.

What is claimed is:

1. An imaging cartridge installable in an image forming device, the image forming device including a rotational driving member and at least one cartridge guide defining a guide path, the cartridge comprising:

a first cartridge portion engageable with the at least one cartridge guide for movement along the guide path; and a second cartridge portion coupled to the first cartridge portion, the second cartridge portion including a drive receiving member configured for engagement with the rotational driving member and at least one of a drum unit assembly, a hopper, a developer roller, and a regulating blade, the second cartridge portion being moveable with respect to the first cartridge portion between a first position in which the drive receiving member is not engageable with the rotational driving member and a second position in which the drive receiving member is engageable with the rotational driving member;

wherein the drum unit assembly defines a longitudinal axis, and where the second cartridge portion moves relative to the first cartridge portion in a direction parallel to the longitudinal axis.

2. The cartridge of claim 1, wherein the drive receiving member is translationally fixed and rotationally fixed to the drum unit assembly.

3. The cartridge of claim 1, further including a cartridge engaging mechanism to move the second cartridge portion relative to the first cartridge portion.

4. The cartridge of claim 3, wherein the cartridge engaging mechanism includes at least one guided body and at least one guiding member that guides movement of the at least one guided body.

5. The cartridge of claim 3, wherein the cartridge engaging mechanism includes a force transfer surface for transferring and exerting a force from at least one of the first cartridge portion and the second cartridge portion to move the first cartridge portion.

6. The cartridge of claim 5, wherein the force transfer surface is a cam body moveably disposed on the first cartridge portion, wherein the cam body is engageable with the second cartridge portion to permit movement of the second cartridge portion between the first position and the second position.

7. An imaging cartridge installable in an image forming device, the image forming device including a rotational driving member and at least one cartridge guide defining a guide path, the cartridge comprising:

a first cartridge portion engageable with the at least one cartridge guide for movement along the guide path;

a second cartridge portion coupled to the first cartridge portion, the second cartridge portion including a drive receiving member configured for engagement with the rotational driving member and at least one of a drum unit assembly, a hopper, a developer roller, and a regulating blade, the second cartridge portion being moveable with respect to the first cartridge portion between a first position in which the drive receiving member is not engageable with the rotational driving member and a second position in which the drive receiving member is engageable with the rotational driving member; and a cartridge engaging mechanism to move the second cartridge portion relative to the first cartridge portion;

wherein the cartridge engaging mechanism includes a force transfer surface for transferring and exerting a force from at least one of the first cartridge portion and the second cartridge portion to move the first cartridge portion;

wherein the force transfer surface is a cam body moveably disposed on the first cartridge portion, wherein the cam body is engageable with the second cartridge portion to permit movement of the second cartridge portion between the first position and the second position; and wherein the cam body is a rotatable cam body having a first lobed portion and a second lobed portion, wherein the second lobed portion is larger than the first lobed portion.

8. The cartridge of claim 1, further comprising a biasing member to urge the second cartridge portion towards the first position.

9. The cartridge of claim 7, wherein the second cartridge portion moves to the first position in response to abutment between the first lobed portion and the second cartridge portion, and wherein the second cartridge portion moves to the second position in response to abutment between the second lobed portion and the second cartridge portion.

10. An imaging cartridge installable in an image forming device, the image forming device including a rotational driving member and at least one cartridge guide defining a guide path, the cartridge comprising:

a first cartridge portion engageable with the at least one cartridge guide for movement along the guide path;

a second cartridge portion coupled to the first cartridge portion, the second cartridge portion including a drive receiving member configured for engagement with the rotational driving member and at least one of a drum unit assembly, a hopper, a developer roller, and a regulating blade, the second cartridge portion being moveable with respect to the first cartridge portion between a first position in which the drive receiving member is not engageable with the rotational driving member and a second position in which the drive receiving member is engageable with the rotational driving member; and a cartridge engaging mechanism to move the second cartridge portion relative to the first cartridge portion;

wherein the cartridge engaging mechanism includes a force transfer surface for transferring and exerting a force from at least one of the first cartridge portion and the second cartridge portion to move the first cartridge portion;

wherein the force transfer surface is a ramped rail moveably disposed on the first cartridge portion, wherein the ramped rail is engageable with the second cartridge portion to permit movement of the second cartridge portion between the first position and the second position.

11. An imaging cartridge installable in an image forming device, the image forming device including a rotational driving member and at least one cartridge guide defining a guide path, the cartridge comprising:

a first cartridge portion engageable with the at least one cartridge guide for movement along the guide path; and a second cartridge portion coupled to the first cartridge portion, the second cartridge portion including a drive receiving member configured for engagement with the rotational driving member and at least one of a drum unit assembly, a hopper, a developer roller, and a regulating blade, the second cartridge portion being moveable with respect to the first cartridge portion between a first position in which the drive receiving member is not engageable with the rotational driving member and a second position in which the drive receiving member is engageable with the rotational driving member;

wherein the drive receiving member and the rotational driving member are decoupled when the second cartridge portion, and more specifically, the drum unit assembly is in the first position.

12. An imaging cartridge comprising:

a first frame; and a second frame at least partially supported by the first frame and comprising a rotatable imaging component selected from the group consisting of a developer roller, a photoconductive drum, and a charging roller, wherein the rotatable imaging component is rotatable about an axis, and wherein the second frame is moveable relative to the first frame in a direction having at least a component that is parallel to the axis; and a cartridge engaging mechanism to move the second cartridge portion relative to the first cartridge portion;

wherein the cartridge engaging mechanism includes a cam body moveably disposed on the first cartridge portion, wherein the cam body defines a force transfer surface that is engageable with the second cartridge portion to move the second cartridge portion between the first position and the second position; and wherein the cam body is a rotatable cam body having a first lobed portion and a second lobed portion, wherein the second lobed portion is larger than the first lobed portion.

13. The cartridge of claim 12, further comprising a drive receiving member that is translationally fixed and rotationally fixed to the rotatable imaging component, and wherein the drive receiving member is configured to transmit rotational motion to the rotatable imaging component.

14. The cartridge of claim 12, wherein the cartridge engaging mechanism includes at least one guided body and at least one guiding member that guides movement of the at least one guided body.

15. The cartridge of claim 12, wherein the second cartridge portion moves to the first position in response to abutment between the first lobed portion and the second cartridge portion, and wherein the second cartridge portion moves to the second position in response to abutment between the second lobed portion and the second cartridge portion.

16. The cartridge of claim 12, further comprising a biasing member to urge the second cartridge portion towards the first position.

* * * * *